US011692765B2

(12) United States Patent
Hunter et al.

(10) Patent No.: US 11,692,765 B2
(45) **Date of Patent: *Jul. 4, 2023**

(54) APPLIANCE TRIM BREAKER ASSEMBLY

(71) Applicant: WHIRLPOOL CORPORATION, Benton Harbor, MI (US)

(72) Inventors: Lynne F. Hunter, Dorr, MI (US); Deepak Gajanan Mankar, Pune (IN); Abhay Naik, Stevensville, MI (US); Sanjesh Kumar Pathak, Stevensville, MI (US); Sanket V. Phalak, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/749,996

(22) Filed: May 20, 2022

(65) Prior Publication Data

US 2022/0282905 A1 Sep. 8, 2022

Related U.S. Application Data

(63) Continuation of application No. 17/153,515, filed on Jan. 20, 2021, now Pat. No. 11,340,008.

(51) Int. Cl.
*F25D 23/08* (2006.01)
*F25D 23/06* (2006.01)

(52) U.S. Cl.
CPC ..... *F25D 23/085* (2013.01); *F25D 23/062* (2013.01); *F25D 23/066* (2013.01)

(58) Field of Classification Search
CPC .... F25D 23/082; F25D 23/062; F25D 23/066; F25D 23/085
See application file for complete search history.

(56) References Cited

U.S. PATENT DOCUMENTS

| | | | | |
|---|---|---|---|---|
| 2,002,366 | A | 5/1935 | Eto | |
| 2,254,604 | A | 9/1941 | Forsthoefel | |
| 2,995,649 | A | 8/1961 | Cyrus | |
| 3,380,615 | A * | 4/1968 | Kessler | F25D 23/085 220/592.06 |
| 3,489,477 | A | 1/1970 | Harder, Jr. | |
| 3,622,215 | A | 11/1971 | Roberts et al. | |
| 3,612,848 | A | 12/1971 | Koch et al. | |
| 3,633,783 | A | 1/1972 | Aue | |
| 4,142,092 | A | 2/1979 | Abrams | |

(Continued)

FOREIGN PATENT DOCUMENTS

| | | |
|---|---|---|
| DE | 9114202 U1 | 1/1992 |
| EP | 3623731 A1 | 3/2020 |

(Continued)

*Primary Examiner* — Daniel J Rohrhoff
(74) *Attorney, Agent, or Firm* — Price Heneveld LLP

(57) ABSTRACT

A refrigerator appliance includes a cabinet with a liner spaced apart from a wrapper. A trim breaker is operably coupled with the liner and the wrapper. A trim adapter assembly is coupled with the trim breaker and includes an adapter member and a corner member. The trim breaker defines a forward receiving space and a protrusion of the trim adapter assembly is received by the forward receiving space. A heat loop assembly is operably coupled with the adapter member. The heat loop assembly includes a cover and a heat loop disposed between the cover and the trim breaker.

20 Claims, 15 Drawing Sheets

(56) References Cited

U.S. PATENT DOCUMENTS

| | | | | |
|---|---|---|---|---|
| 4,918,579 | A | 4/1990 | Bennett | |
| 5,720,536 | A | 2/1998 | Jenkins et al. | |
| 5,937,666 | A | 8/1999 | Trulaske, Sr. | |
| 6,178,763 | B1 | 1/2001 | Brancheau et al. | |
| 6,210,013 | B1 | 4/2001 | Bousfield | |
| 6,266,970 | B1 | 7/2001 | Nam et al. | |
| 6,406,108 | B1 | 6/2002 | Upton et al. | |
| 6,464,312 | B1 * | 10/2002 | Tenhundfeld | E05C 19/161 49/478.1 |
| 6,485,122 | B2 | 11/2002 | Wolf et al. | |
| 6,655,766 | B2 | 12/2003 | Hodges | |
| 6,726,341 | B2 | 4/2004 | Pashley et al. | |
| 7,559,672 | B1 | 7/2009 | Parkyn et al. | |
| 8,128,251 | B2 | 3/2012 | Huang et al. | |
| 8,388,171 | B2 | 3/2013 | Tung et al. | |
| 8,899,070 | B2 | 12/2014 | Eckartsberg et al. | |
| 9,879,900 | B1 | 1/2018 | Ammerman et al. | |
| 10,801,773 | B2 | 10/2020 | Shannigrahi | |
| 10,914,514 | B1 * | 2/2021 | Hunter | F25D 23/066 |
| 11,340,008 | B1 * | 5/2022 | Hunter | F25D 21/04 |
| 2002/0021062 | A1 * | 2/2002 | Hodges | F25D 23/085 312/401 |
| 2008/0315735 | A1 | 12/2008 | Fabbro et al. | |
| 2009/0244884 | A1 | 10/2009 | Trulaske, Sr. | |
| 2010/0014288 | A1 | 1/2010 | Kreutzer et al. | |
| 2010/0254116 | A1 | 10/2010 | Lee | |
| 2011/0058353 | A1 | 3/2011 | Yang | |
| 2011/0235307 | A1 | 9/2011 | Hernandez | |
| 2012/0164923 | A1 * | 6/2012 | Jiang | B24B 53/017 451/56 |
| 2014/0216706 | A1 | 8/2014 | Melton et al. | |
| 2015/0135761 | A1 | 5/2015 | Jang | |
| 2016/0258671 | A1 * | 9/2016 | Allard | F25D 23/085 |
| 2016/0290708 | A1 | 10/2016 | Bassan et al. | |
| 2017/0292776 | A1 | 10/2017 | Kim et al. | |
| 2019/0120547 | A1 | 4/2019 | Staud et al. | |
| 2019/0126547 | A1 | 5/2019 | DeSimone et al. | |
| 2019/0176431 | A1 * | 6/2019 | Carlson | B31D 5/0043 |
| 2019/0310011 | A1 | 10/2019 | Marinello et al. | |
| 2021/0231361 | A1 * | 7/2021 | Celik | F25D 23/085 |

FOREIGN PATENT DOCUMENTS

| | | | |
|---|---|---|---|
| WO | 2009141128 | A1 | 11/2009 |
| WO | 2018080472 | A1 | 5/2018 |
| WO | 2019108204 | A1 | 6/2019 |

* cited by examiner

APPLIANCE TRIM BREAKER ASSEMBLY

CROSS-REFERENCE TO RELATED APPLICATION

This application is a continuation of U.S. application Ser. No. 17/153,515, filed on Jan. 20, 2021, now U.S. Pat. No. 11,340,008, entitled "APPLIANCE TRIM BREAKER ASSEMBLY," the disclosure of which is hereby incorporated herein by reference in its entirety.

BACKGROUND OF THE DISCLOSURE

The present disclosure generally relates to an appliance trim breaker assembly and more specifically, to an appliance trim breaker assembly having adapter members.

SUMMARY OF THE DISCLOSURE

According to one aspect of the present disclosure, a refrigerator appliance includes a cabinet with a liner spaced apart from a wrapper. A trim breaker is operably coupled with the liner and the wrapper. A trim adapter assembly is coupled with the trim breaker and includes an adapter member and a corner member. The trim breaker defines a forward receiving space and a protrusion of the trim adapter assembly is received by the forward receiving space. A heat loop assembly is operably coupled with the adapter member. The heat loop assembly includes a cover and a heat loop disposed between the cover and the trim breaker.

According to another aspect of the present disclosure, a refrigerator appliance includes a cabinet with an inner liner, an outer wrapper, and a trim breaker. An adapter member includes a plurality of engagement arms and a leg that extends along a portion of the trim breaker. The trim breaker defines a receiving space configured to receive the leg. A cover is configured to be engaged with the plurality of engagement arms to couple the cover with a trim adapter assembly. A heat loop is in abutting contact with an inside surface of the cover.

According to yet another aspect of the present disclosure, a refrigerator appliance includes a cabinet with an inner liner operably coupled to an outer wrapper. A trim breaker is operably coupled to the inner liner and the outer wrapper. A trim adapter assembly is operably coupled to the trim breaker and includes an upper member, a first side member, a second side member, and a lower member. The upper member is detachably coupled to the first side member and the second side member and the lower member is detachably coupled to the first side member and the second side member. A cover is engaged with an adapter member by a plurality of clips interspaced along a clip member.

These and other features, advantages, and objects of the present disclosure will be further understood and appreciated by those skilled in the art by reference to the following specification, claims, and appended drawings.

Figure 1:
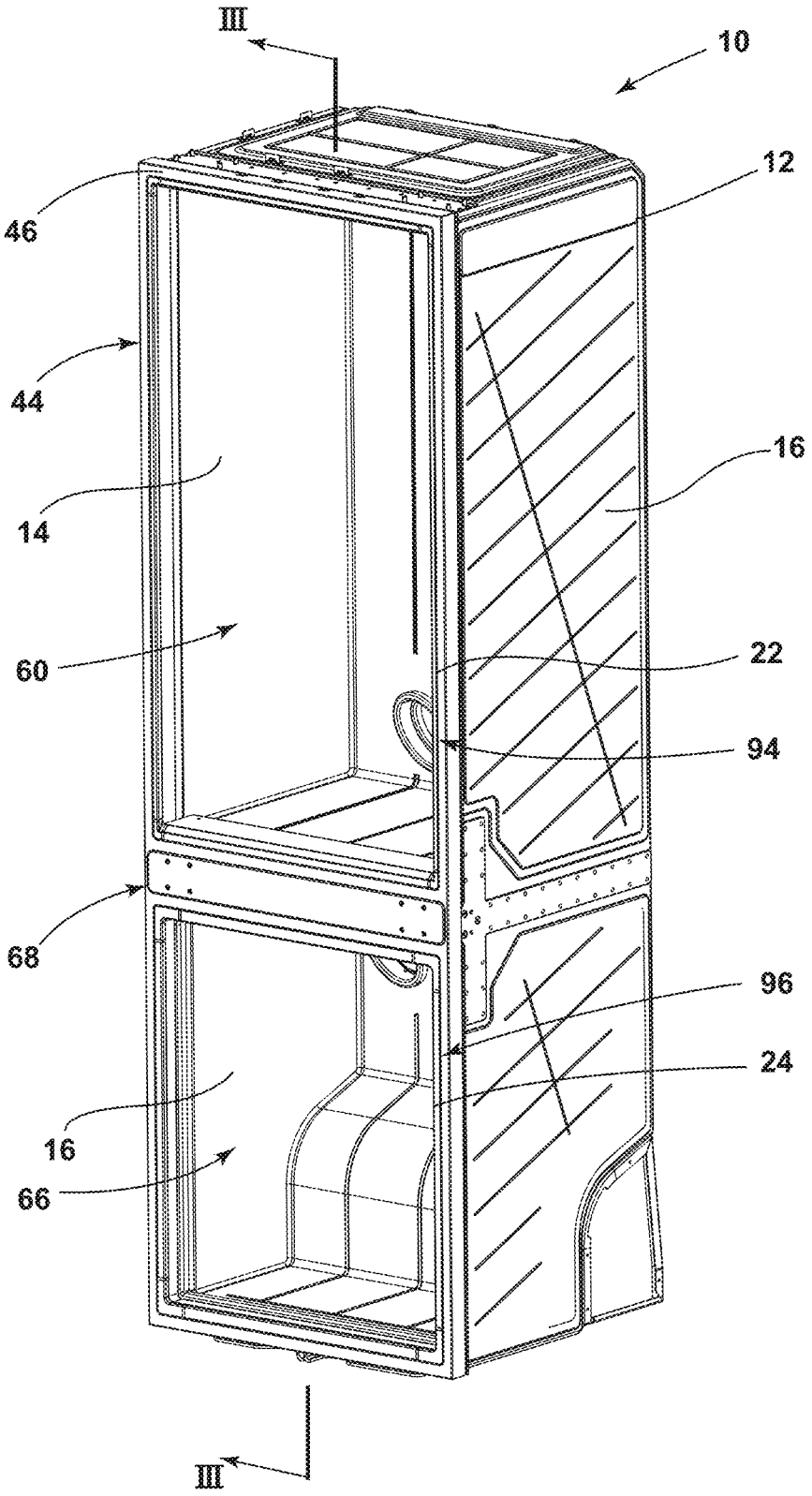
FIG. 1 is a side perspective view of an appliance cabinet, according to various examples.

The components in the figures are not necessarily to scale, emphasis instead being placed upon illustrating the principles described herein.

DETAILED DESCRIPTION

The present illustrated embodiments reside primarily in combinations of method steps and apparatus components related to an appliance trim breaker assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-11, reference numeral 10 generally designates a refrigerator appliance that includes a cabinet 12. The cabinet 12 includes a liner 14, 16 spaced apart from a wrapper 18. A trim breaker 20 extends between the liner 14, 16 and the wrapper 18. A trim adapter assembly 22, 24 coupled with the trim breaker 20 and including an adapter member 26, 28, 30, 32 and a corner member 34. The adapter member 26, 28, 30, 32 includes at least one engagement arm 36, 38, 40, 42. A heat loop assembly 44 is operably coupled with the adapter member 26, 28, 30, 32 and includes a cover 46 and a heat loop 48. The cover 46 includes a clip member 50 extending along an edge 52, 54 of the cover 46. The heat loop 48 is coupled with the cover 46 via the clip member 50.

Referring again to FIGS. 1 and 2, the cabinet 12 of an appliance 10 is illustrated including a trim breaker 20, a first adapter assembly 22, a second trim adapter assembly 24, and a heat loop assembly 44. The cabinet 12 includes a refrigerator compartment liner 14 and a freezer compartment liner 16. The refrigerator compartment liner 14 and the freezer compartment liner 16 are in a spaced-apart configuration forming the refrigerator compartment 60 and a freezer compartment 66. A mullion 68 is disposed between the refrigerator compartment liner 14 and the freezer compartment liner 16. As illustrated, according to one embodiment, the freezer compartment 66 is arranged in a bottom-mount configuration relative to the refrigerator compartment 60. Although the freezer compartment 66 is shown as the "bottom freezer" type, the teachings set forth herein are applicable to other types of cooling appliances, including but not limited to, side-by-side refrigerator/freezers, top-mount freezers, etc. Accordingly, embodiments of the present disclosure are therefore not intended to be limited to any particular type and/or configuration of the refrigeration appliance 10.

The refrigerator compartment liner 14 includes first and second opposing side walls 72, 74, a top wall 76, and a bottom wall 78. The freezer compartment liner 16 includes first and second opposing side walls 82, 84 and is positioned to align with the refrigerator compartment liner 14. The freezer compartment liner 16 further includes a top wall 86 and a bottom wall 88 extending between the first and second side walls 82, 84. The top wall 86 of the freezer compartment liner 16 may be spaced apart from the bottom wall 78 of the refrigerator compartment liner 14 by the mullion 68. A forward edge 92 of the refrigerator compartment liner 14 extends along each of the walls 72, 74, 76, 78 and defines a first opening 94. A forward edge 96 of the freezer compartment liner 16 extends along each of the walls 82, 84, 86, 88 and defines a second opening 98. The first opening 92 is in communication with the refrigerator compartment 60, and the second opening 98 is in communication with the freezer compartment 66.

Figure 2:
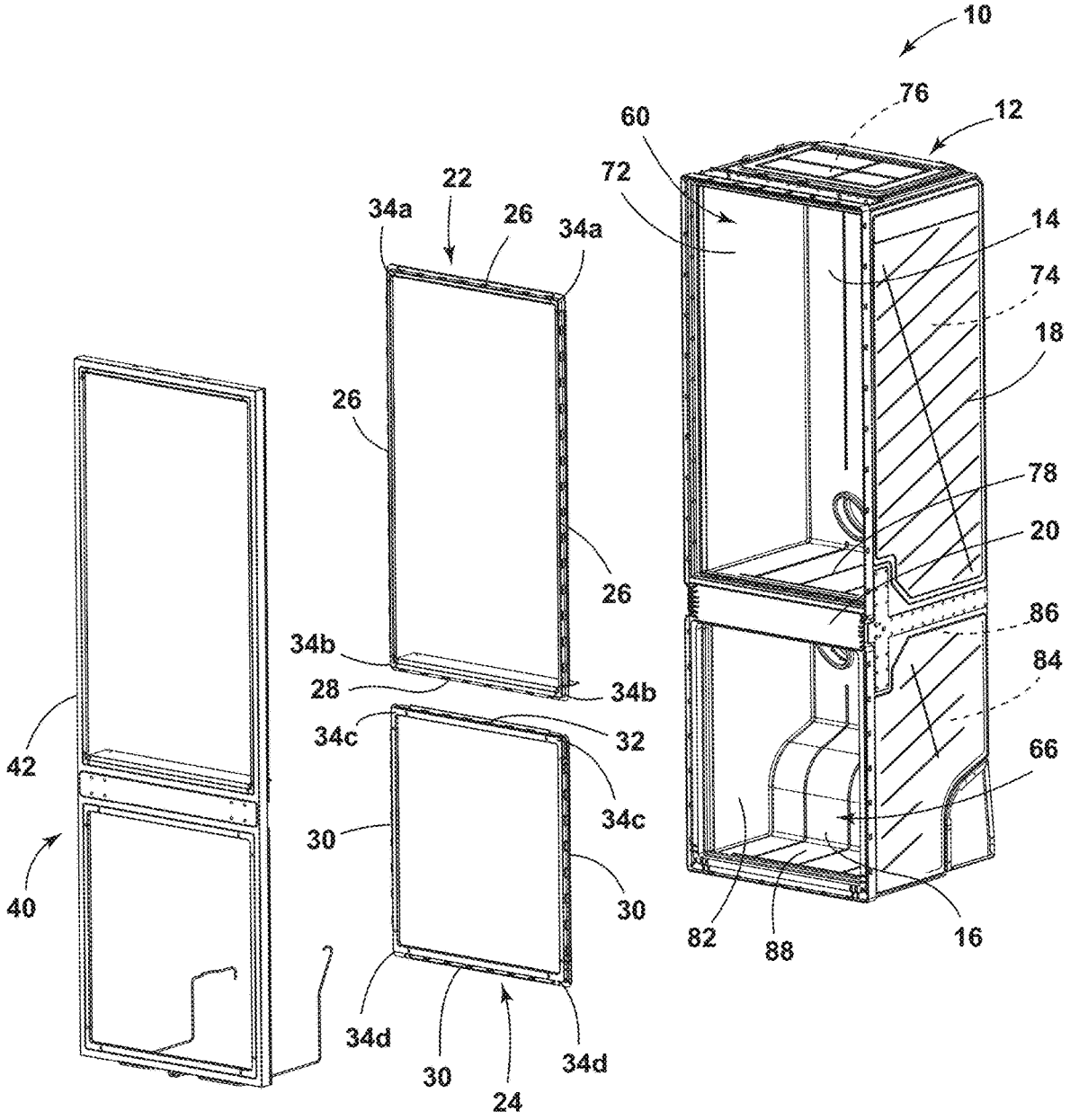
FIG. 2 is an exploded side perspective view of the appliance cabinet of FIG. 1.
Figure 3:
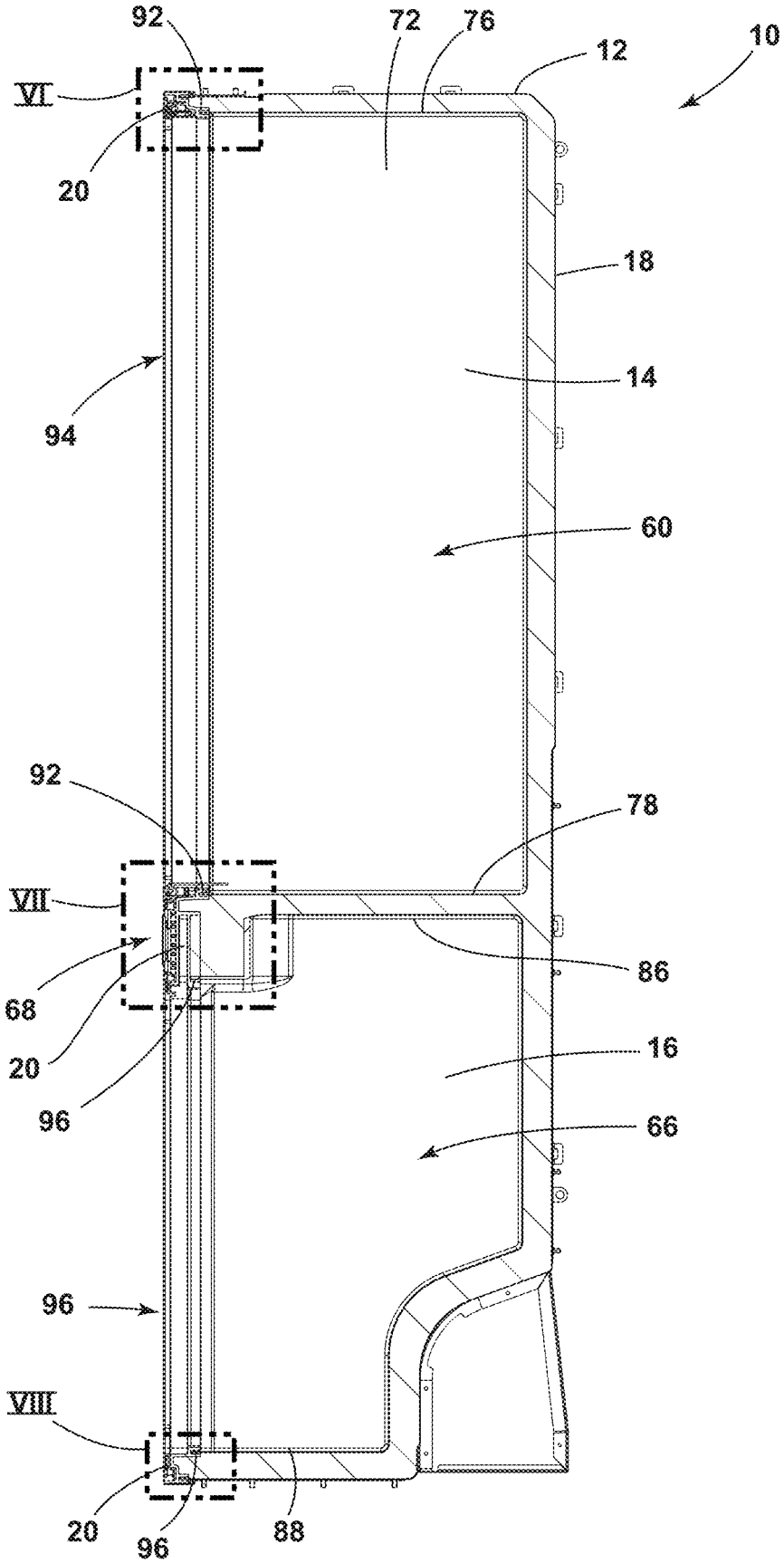
FIG. 3 is a side profile view of a cross-section of the appliance cabinet of FIG. 1 taken along line III-III.

As shown in FIGS. 2 and 3, a trim breaker 20 is coupled with and extends between one of the refrigerator compartment liner 14 and the freezer compartment liner 16 and the wrapper 18 of the cabinet 12. The trim breaker 20 extends along the forward edge 92, 96 of each of the refrigerator compartment liner 14 and the freezer compartment liner 16. In various examples, the trim breaker 20 may be coupled with the forward edge 92, 96 of each of the liners 14, 16 and may be further coupled with the wrapper 18 (see FIGS. 6-8). As illustrated in FIG. 2, the trim breaker 20 may be a continuous member. However, it is contemplated that the trim breaker 20 may be formed of individual members without departing from the scope of the present disclosure.

Figure 4:
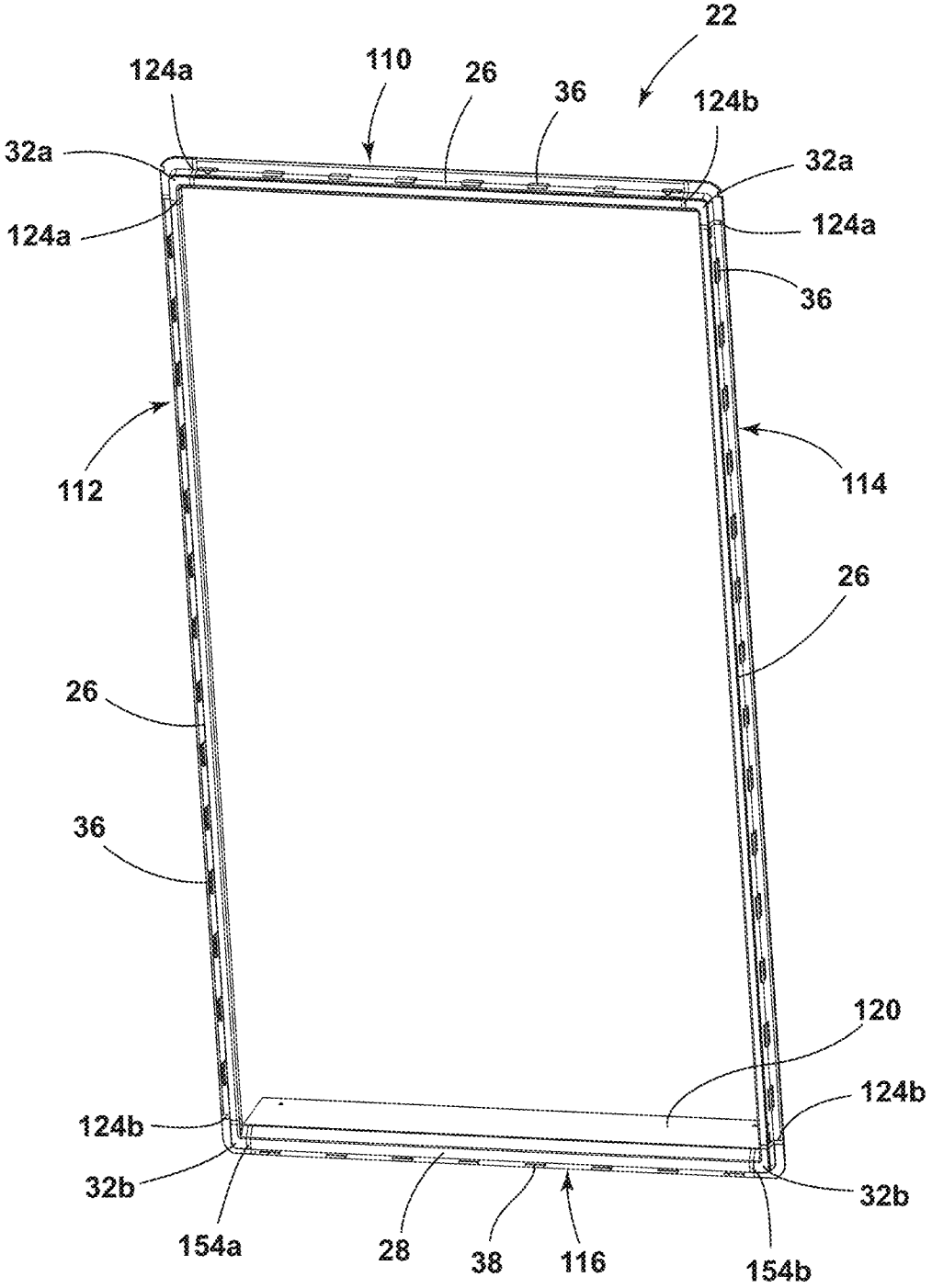
FIG. 4 is a side perspective view of a first trim adapter assembly, according to various examples.
Figure 5:
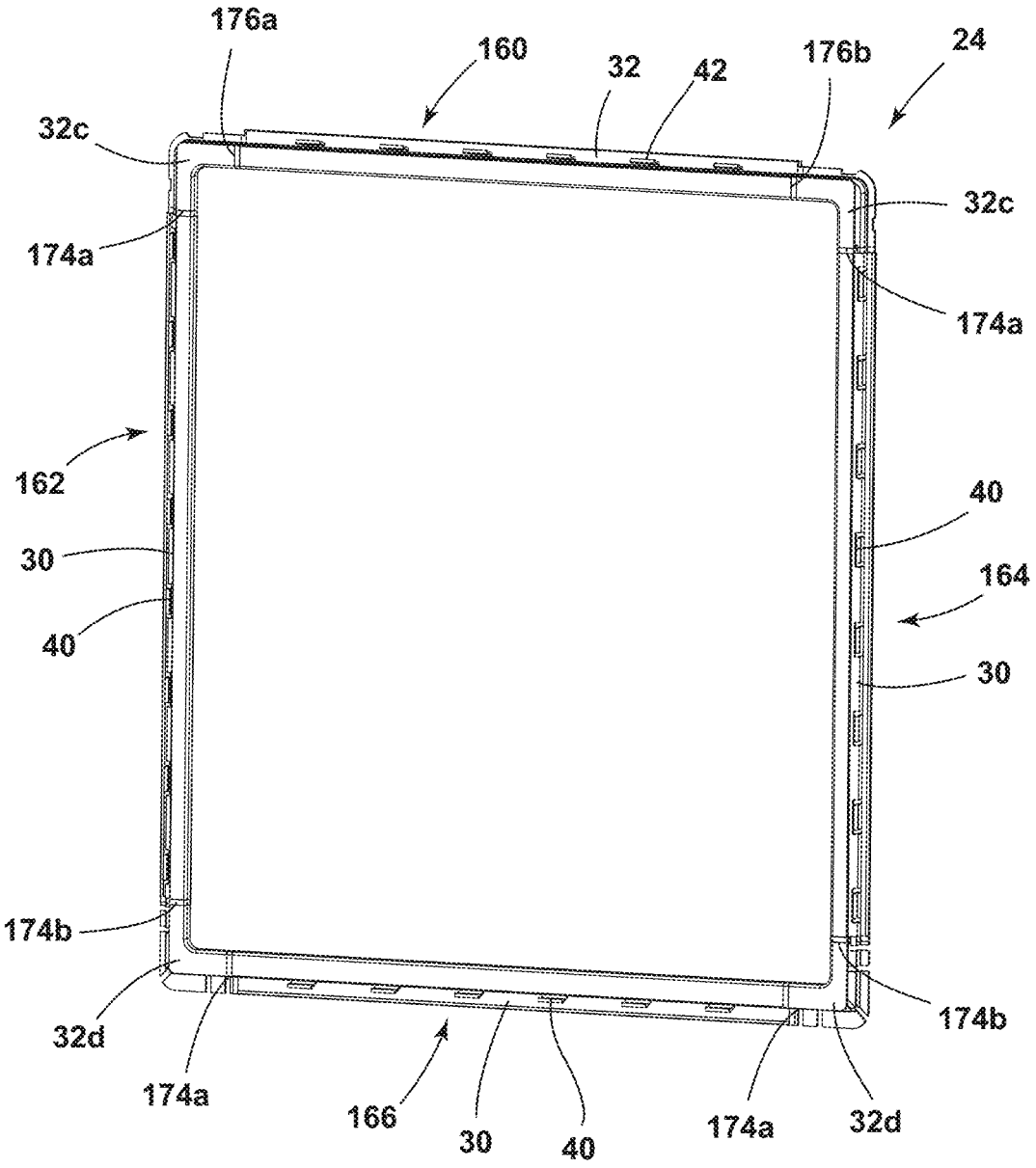
FIG. 5 is a side perspective view of a second trim adapter member assembly, according to various examples.

Referring now to FIGS. 3-5, the appliance 10 further includes the first and second adapter assemblies 22, 24, as introduced above. As best shown in FIG. 4, the first trim adapter assembly 22 includes an upper member 110 and side members 112, 114. Each of the upper and side members 110, 112, 114 is configured as a first adapter member 26. The upper member 110 is joined with and extends between the side members 112, 114. A lower member 116 is configured as a second adapter member 28 and extends between the side members 112, 114 such that the upper member 110, side members 112, 114 and the lower member 116 form a substantially rectangular shape configured to frame the first opening 94. An extension member 210 may be coupled with the second adapter member, as described in more detail elsewhere herein.

Figure 4A:
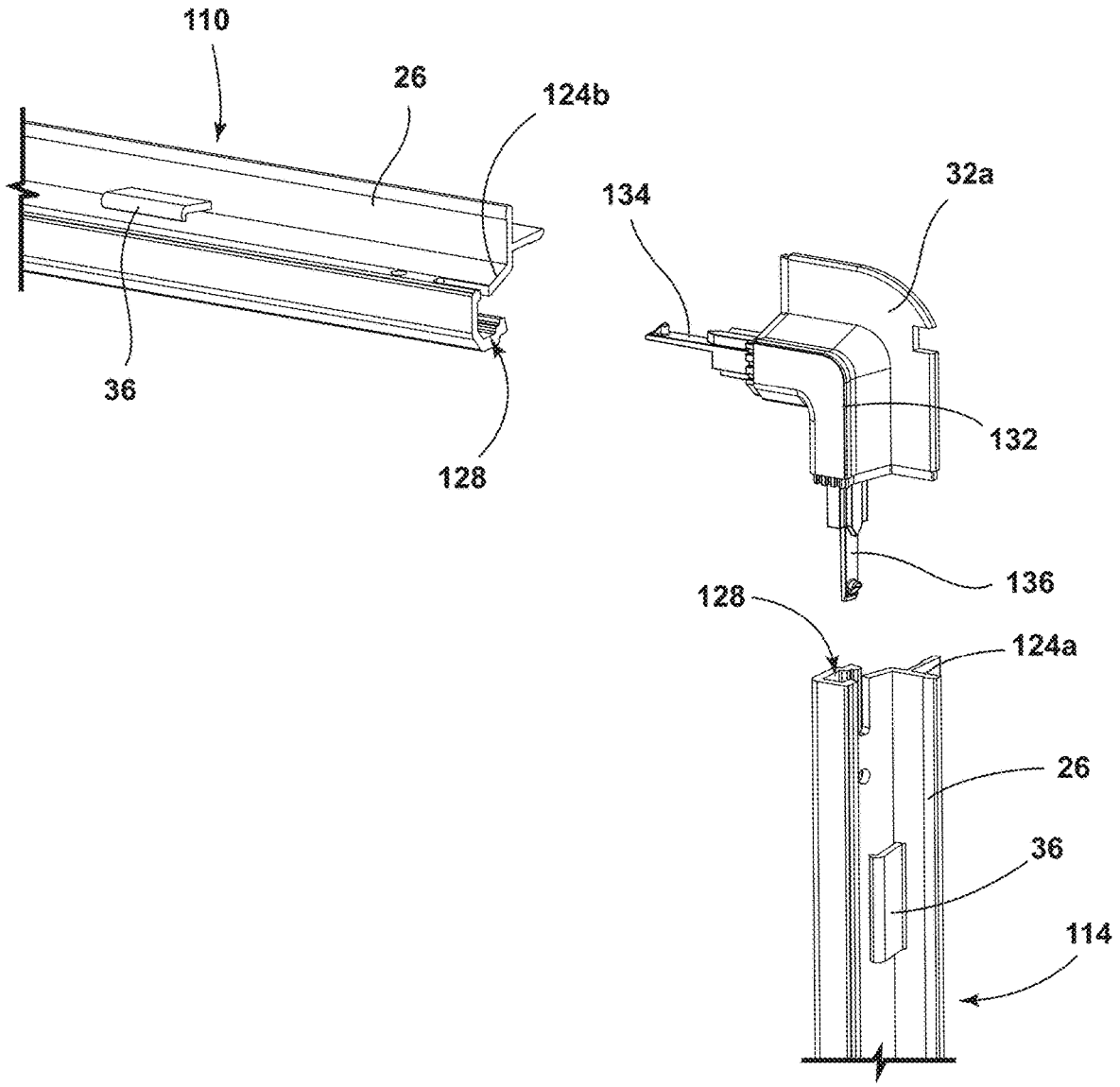
FIG. 4A is an exploded partial side perspective view of an upper corner of the first trim adapter assembly of FIG. 4.

Referring now to FIGS. 4 and 4A, each of the side members 112, 114 is coupled with the upper member 110 by a respective first corner member 34*a*. FIG. 4A illustrates one of the first corner members 34*a* exploded away from the upper member 110 and one of the side members 114. While only the single first corner member 34*a* is described in detail, it will be understood that each first corner member 34*a* includes substantially similar features and may be engaged with any one of the first adapter members 26 as described.

As illustrated in FIGS. 4 and 4A, each of the upper member 110 and the side members 112, 114 includes opposing first and second ends 124*a*, 124*b*. Each end 124*a*, 124*b* defines a receiving well 128 configured to at least partially receive the respective corner member 34*a*. As best shown in FIG. 4A, the first corner member 34*a* includes a body 132 configured to define an upper corner of the first trim adapter assembly 22. First and second prongs 134, 136 extend from the body 132. The first prong 134 is positioned substantially perpendicular to the second prong 136. Each of the first and second prongs 134, 136 is configured to be received by the receiving well 128 of one of the upper member 110 and the side member 112, 114 to couple the respective member 110, 112, 114 with the first corner member 34*a*.

Figure 4B:
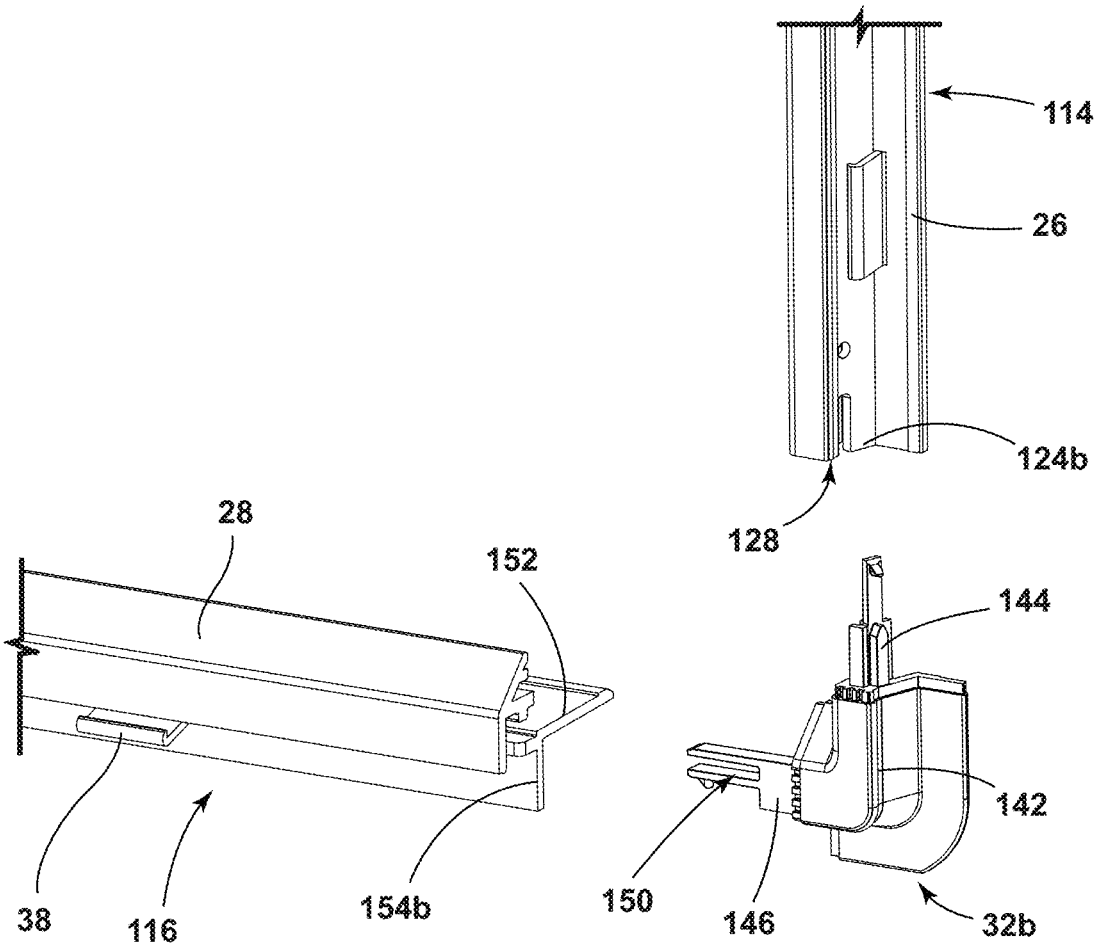
FIG. 4B is an exploded partial side perspective view of a lower corner of the first trim adapter assembly of FIG. 4.

Referring now to FIGS. 4 and 4B, the lower member 116 is coupled with each of the side members 112, 114 by a respective second corner member 34*b*. FIG. 4B illustrates one of the second corner members 34*b* exploded away from the lower member 116 and one of the side members 114. While only a single second corner member 34*b* is described in detail, it will be understood that each second corner member 34*b* includes substantially similar features and may be engaged with the lower member 116 and any one of the side members 112, 114 as described.

As illustrated in FIGS. 4 and 4B, the lower member 116 includes opposing first and second ends 154*a*, 154*b*. Each end 154*a*, 154*b* is positioned proximate a second end 124*b* of a respective side member 112, 114. As shown in FIG. 4B, the end 124*b* of the side member 114 defines a receiving well 128 configured to at least partially receive the respective corner member 34*b*. As best shown in FIG. 4B, the second corner member 34*b* includes a body 142 configured to define a lower corner of the first trim adapter assembly 22. First and second prongs 144, 146 extend from the body 142. The first prong 144 is positioned substantially perpendicular to the second prong 146 and is configured to be received by the receiving well 128 of the side member 114 to couple the side member 114 with the second corner member 34*b*. The second prong 144 defines a space 150 configured to at least partially receive a central portion 152 of the lower member 116 to couple the lower member 116 with the second corner member 34*b*.

As best shown in FIG. 5, the second trim adapter assembly 24 includes side members 162, 164 and a lower member 166. Each of the side members 162, 164 and the lower member 166 is configured as a third adapter member 30. The lower member 166 is joined with and extends between the side members 162, 164. An upper member 160 is configured as a fourth adapter member 32 and extends between the side members 162, 164 such that the upper member 160, side members 162, 164 and the lower member 166 form a substantially rectangular shape configured to frame the second opening 98.

Figure 5A:
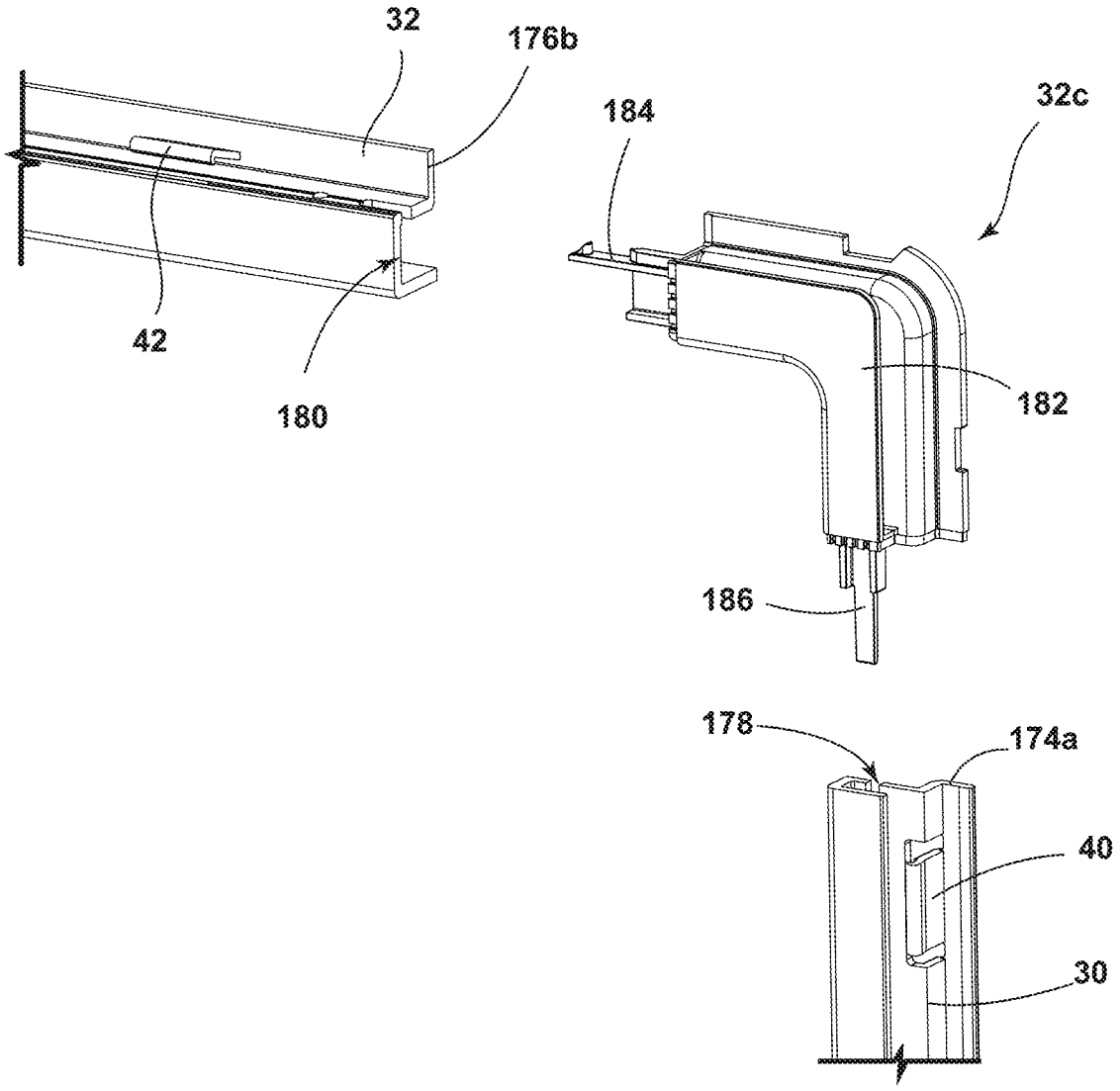
FIG. 5A is an exploded partial side perspective view of an upper corner of the second trim adapter assembly of FIG. 5.

Referring now to FIGS. 5 and 5A, each of the side members 162, 164 is coupled with the upper member 160 by a respective third corner member 34*c*. FIG. 5A illustrates one of the third corner members 34*c* exploded away from the upper member 160 and one of the side members 164. While only a single third corner member 34*c* is described in detail, it will be understood that each third corner member 34*c* includes substantially similar features and may be engaged with the upper member 160 and any one of the side members 162, 164 as described.

As illustrated in FIGS. 5 and 5A, the upper member 160 includes opposing first and second ends 176*a*, 176*b*. Each of the side members 162, 164 includes opposing first and second ends 174*a*, 174*b* and are oriented so that the first end 174*a* of each side member 162, 164 is aligned with one of the first and second ends 176*a*, 176*b* of the upper member 160. Each end 176*a*, 176*b* of the upper member 160 defines a respective receiving well 180, and each end 174*a*, 174*b* of the side members 162, 164 defines a respective receiving well 178. Each receiving well 178, 180 may be configured to at least partially receive the respective corner member 34*c*.

As best shown in FIG. 5A, the third corner member 34*c* includes a body 182 configured to define an upper corner of the second trim adapter assembly 24. First and second prongs 184, 186 extend from the body 182. The first prong 184 is positioned substantially perpendicular to the second prong 186 and is configured to be received by the receiving well 180 of one of the ends 176*a*, 176*b* of the upper member 160 to couple the upper member 160 with the third corner member 34*c*. The second prong 186 is configured to be received by the receiving well 178 of the end 174*a* of one of the side members 162, 164 to couple the respective member 162, 164 with the third corner member 34*c*.

Figure 5B:
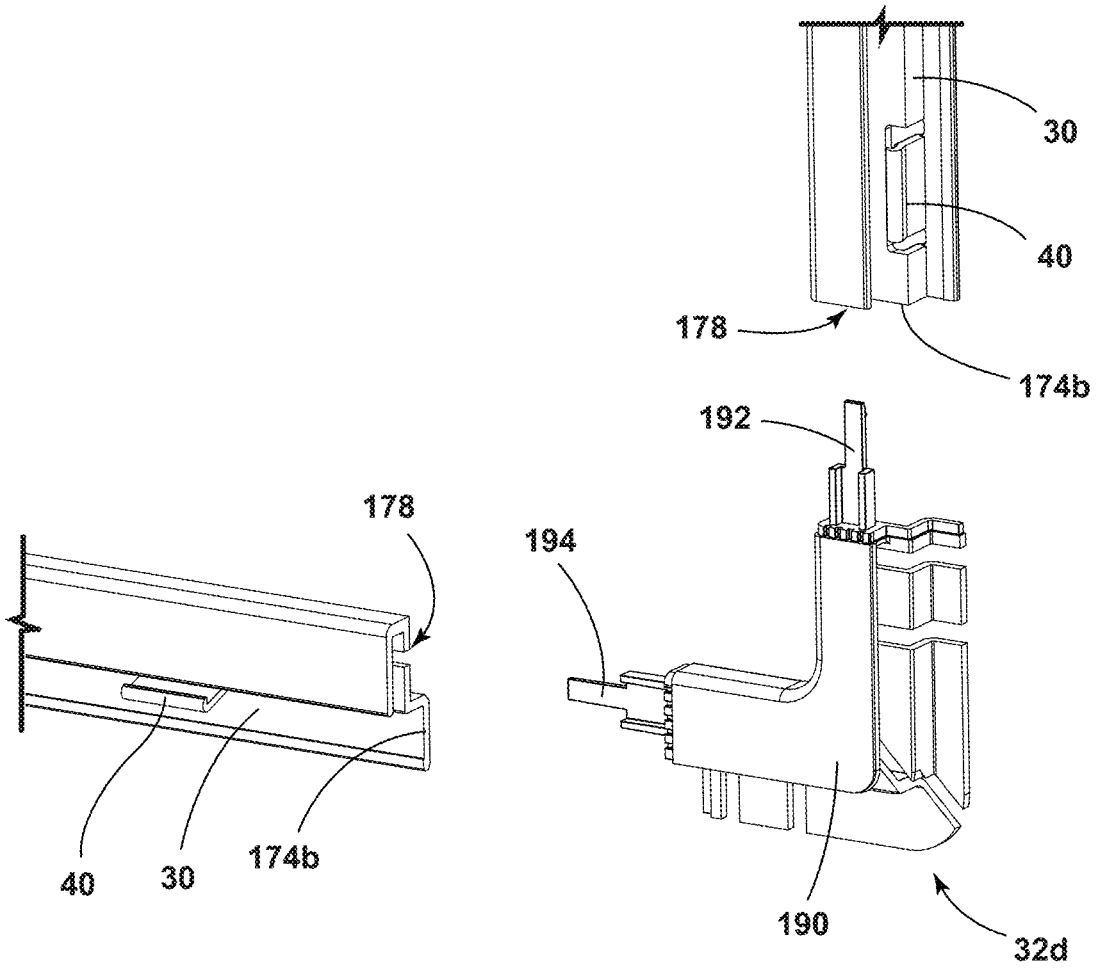
FIG. 5B is an exploded partial side perspective view of a lower corner of the second trim adapter assembly of FIG. 5.

Referring now to FIGS. 5 and 5B, the lower member 166 is coupled with each of the side members 162, 164 by a respective fourth corner member 34*d*. FIG. 5B illustrates one of the fourth corner members 34*d* exploded away from the lower member 166 and one of the side members 164. While only a single fourth corner member 34*d* is described in detail, it will be understood that each fourth corner member 34*d* includes substantially similar features and may be engaged with the lower member 166 and any one of the side members 162, 164 as described.

As illustrated in FIGS. 5 and 5B, each of the first and second side members 162, 164 and the lower member 166 is configured as a third adapter member 30, as previously introduced. Each member 162, 164, 166 includes opposing first and second ends 174*a*, 174*b*. Each end 174*a*, 174*b* of the lower member 166 is positioned proximate a second end 174*b* of a respective side member 162, 164. As best shown in FIG. 5B, the fourth corner member 34*d* includes a body 190 configured to define a lower corner of the second trim adapter assembly 24. First and second prongs 192, 194 extend from the body 190. The first prong 192 is positioned substantially perpendicular to the second prong 194 and is configured to be received by the receiving well 178 of the side member 114 to couple the side member 114 with the fourth corner member 34*d*. The second prong 196 is configured to be received by the receiving well 178 of one of the ends 174*a*, 174*b* of the lower member 166 to couple the lower member 166 with the fourth corner member 34*d*. It will be understood that the corner members 32*a*, 32*b*, 32*c*, 32*d* may be interchangeable based on the cross-sectional geometry of the adapter members 26, 28, 30, 32. It will further be understood that any number of configurations of the corner members 32*a*, 32*b*, 32*c*, 32*d* may be used without departing from the scope of the present disclosure.

Figure 6:
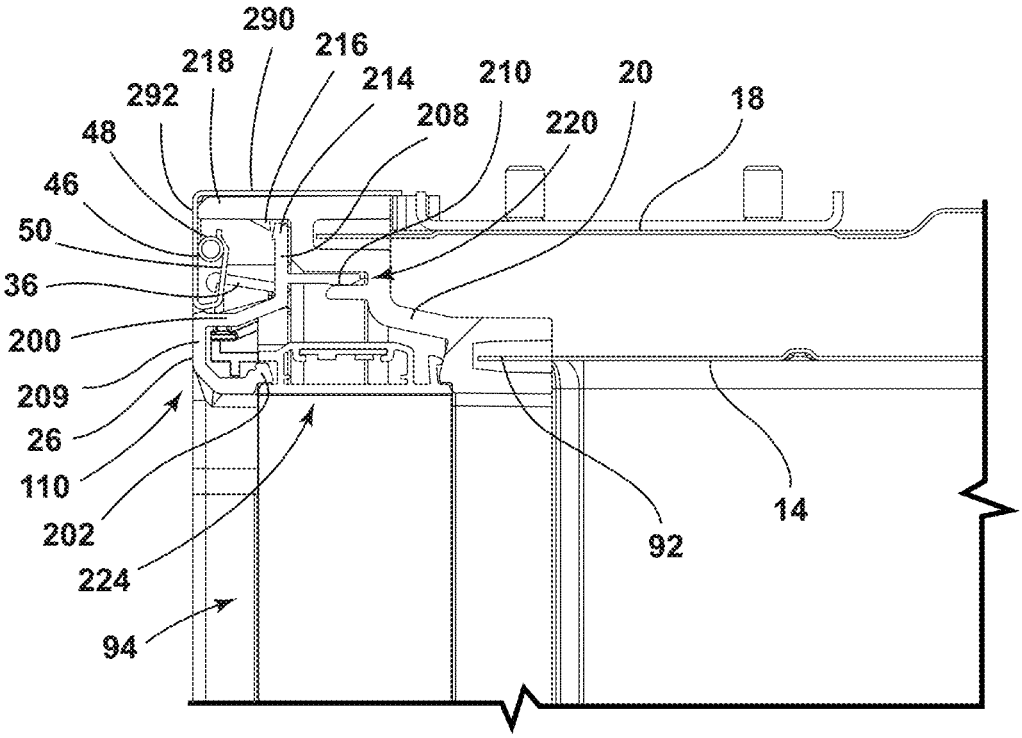
FIG. 6 is an enlarged view of area VI of FIG. 3 illustrating a top wall of the appliance cabinet coupled with a trim breaker assembly.

Referring now to FIG. 6, a cross-sectional view of the upper member 110 of the first trim adapter assembly 22 is illustrated. The upper member 110 is configured as a first adapter member 26, as previously discussed, and is shown engaged with the trim breaker 20 and the heat loop assembly 44. While only the upper member 110 is shown, it will be understood that any member configured as a first adapter member 26 (e.g., each of the side members 112, 114 of the first trim adapter assembly 22) includes substantially the same or substantially similar features and is coupled with the heat loop assembly 44 and the trim breaker 20 in substantially the same manner or in a substantially similar manner.

As shown in FIG. 6, the upper member 110 includes a body 200 having a lower portion 202 extending rearward from a forward portion 204. The forward portion 204 is configured to be aligned with at least a portion of the cover 46 of the heat loop assembly 44. In various examples, the forward portion 204 may be spaced apart from the trim breaker 20 by a light source assembly 224. The lower portion 202 of the trim breaker 20 may be configured to be coupled with the light source assembly 224. In other examples, the forward portion 204 may be spaced apart from the trim breaker 20 by an insert or may extend to the trim breaker 20 such that the lower portion 202 is coupled with the trim breaker 20.

First and second legs 208, 210 of the first adapter member 26 extend from the body 200 and are spaced apart from the lower portion 202 by the forward portion 204. The first leg 208 of the first adapter member 26 extends upward from the body 200 and is positioned substantially parallel with the forward portion 204. The second leg 210 extends rearward from the body 200 and is positioned substantially perpendicular to the first leg 208. Each of the first leg 208 and the second leg 210 is configured to be in contact with, and extend at least partially along, the trim breaker 20.

As shown in FIG. 6, the first leg 208 may include a foot 214. The foot 214 may be configured to abut an outer portion 218 of the trim breaker 20 or may be positioned proximate the outer portion 218 of the trim breaker 20. The outer portion 218 of the trim breaker 20 may include a tab 216 extending inward toward the upper member 110. The tab 216 is configured to engage with the foot 214 of the first leg 208 to retain the upper member 110 in contact with the trim breaker 20.

The trim breaker 20 may further define a receiving space 220 configured to open forward of the trim breaker 20 (e.g., the receiving space 220 may be positioned to open in a direction opposite the forward edge 92 of the refrigerator compartment liner 14.) When the upper member 110 is coupled with the trim breaker 20, the second leg 210 may be inserted into the receiving space 220, and the foot 214 may be engaged with the tab 216. In various examples, the foot 214 may be configured to snap engage with the tab 216. It will be understood that any number of tabs 216 may be defined along the trim breaker 20 to retain the upper member 110 without departing from the scope of the present disclosure.

As shown in FIG. 6, at least one engagement arm 36 extends forwardly from the body 190 of the upper member 110. The engagement arm 36 may be one of a plurality of engagement arms 36 spaced apart along a length of the upper member 110 (see FIG. 4) or may be a continuous engagement arm 36 extending along at least a portion of the length of the upper member 110. The engagement arm 36 may be hook-shaped and configured to engage with the cover 46 of the heat loop assembly 44. For example, the engagement arm 36 may be configured to engage with the clip member 50 of the heat loop assembly 44 to at least partially couple the heat loop assembly 44 with the upper member 110 and the trim breaker 20.

Figure 7:
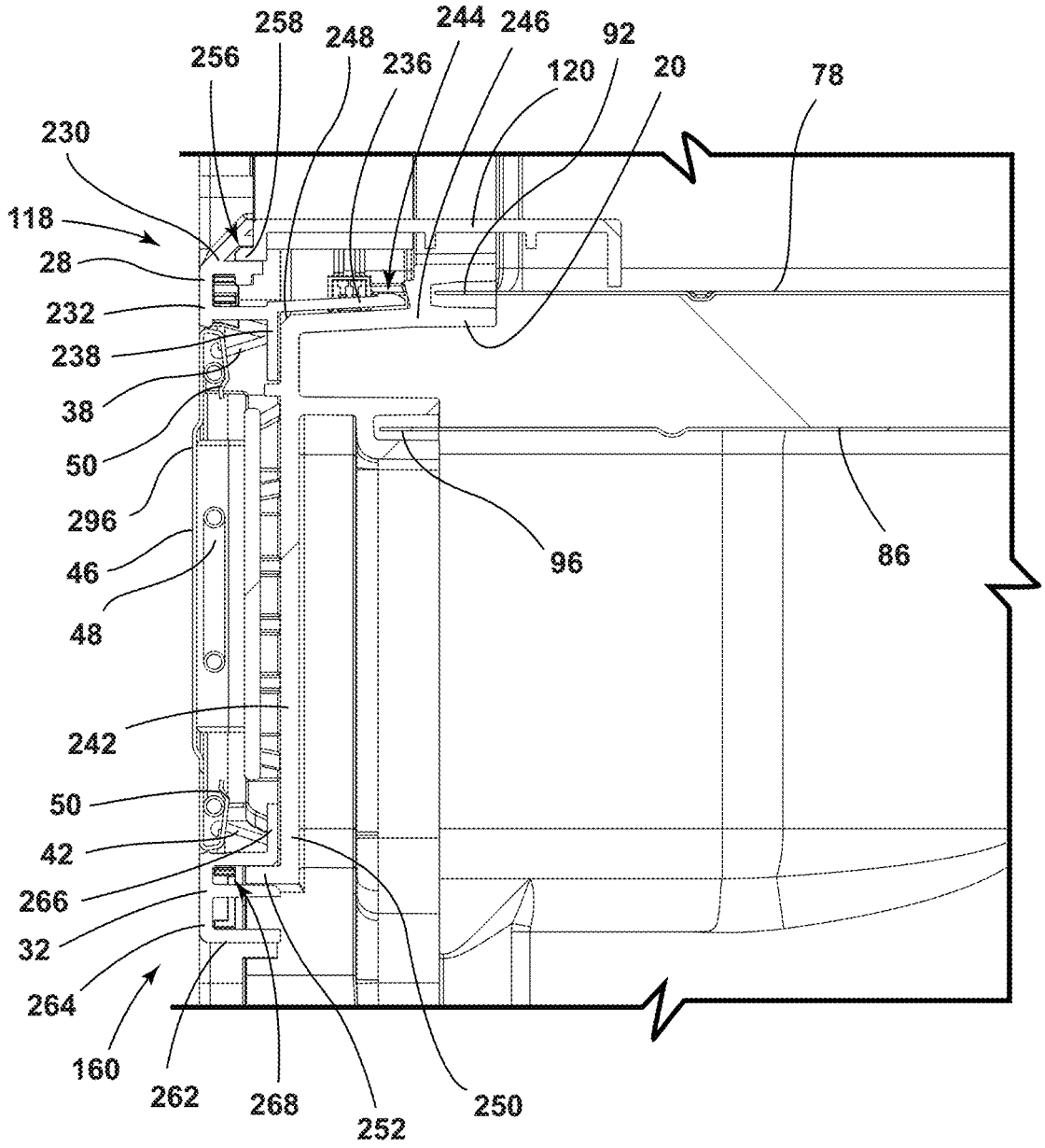
FIG. 7 is an enlarged view of area VII of FIG. 3 illustrating a mullion of the appliance cabinet coupled with a trim breaker assembly.

Referring now to FIG. 7, a cross-sectional view of the mullion 68 of the cabinet 12 of the appliance 10 is illustrated (see FIG. 3). The lower member 116 of the first trim adapter assembly 22 and the upper member 160 of the second trim adapter assembly 24 are illustrated engaged with the trim breaker 20 and the heat loop assembly 44. As previously introduced, the lower member 116 of the first trim adapter assembly 22 is configured as a second adapter member 28, and the upper member 160 of the second trim adapter assembly 24 is configured as a fourth adapter member 32. It will be understood that any member configured as a second adapter member 28 includes substantially the same or substantially similar features to those of the lower member 116 and is coupled with the heat loop assembly 44 and the trim breaker 20 in substantially the same manner or in a substantially similar manner. It will also be understood that any member configured as a fourth adapter member 32 includes substantially the same or substantially similar features to those of the upper member 160 and is coupled with the heat loop assembly 44 and the trim breaker 20 in substantially the same manner or in a substantially similar manner.

As shown in FIG. 7, the lower member 116 of the first trim adapter assembly 22 and the upper portion 160 of the second trim adapter assembly 24 are each coupled with a mullion section 242 of the trim breaker 20. The mullion section 242 of the trim breaker 20 includes an upper portion 246 and a lower portion 250. The upper portion 246 includes an upper corner 248 positioned proximate the first opening 94. The upper portion 246 further defines a receiving space 244 proximate the upper corner 248 and configured to at least partially receive the lower member 116.

Referring now to FIGS. 3 and 7, the lower member 116 of the first trim adapter assembly 22 is configured as a second adapter member 28, as previously introduced. The lower member 116 includes a body 230 positioned forward of the upper portion 246 of the trim breaker 20. In various examples, the body 230 may be positioned at least partially above the upper portion 246 of the trim breaker 20 and includes a forward portion 232. The forward portion 232 is positioned to at least partially align with the cover 46 and may be configured to at least partially conceal the mullion section 242 of the trim breaker 20 and/or a portion of the lower member 116. The body 230 may further include the central portion 152, as previously discussed with respect to the corner member 34*b*. The central portion 152 may be integrally formed with the forward portion 232.

The lower member 116 further includes a first leg 236 extending rearward from the central portion 152 and is positioned substantially perpendicular to the forward portion 232. The first leg 236 extends along the upper portion 246 of the mullion section 242 of the trim breaker 20 and may be received by the receiving space 244. A second leg 238 extends downward from the first leg 236 and is substantially perpendicular to the first leg 236. The second leg 238 may be positioned to extend along the upper portion 246 of the mullion section 242 of the trim breaker 20 such that the first and second legs 236, 238 of the lower member 116 are positioned to frame the upper corner 248 of the upper portion 246.

As shown in FIG. 7, the body 230 of the lower member 116 may be configured to couple with the extension member 120. The body 230 defines a coupling space 256 positioned above the upper portion of the trim breaker 20. The coupling space 256 is configured to receive a forward end 258 of the extension member 120. When the forward end 258 is received by the coupling space 256, the extension member 120 is positioned to extend over the upper portion 246 of the trim breaker 20 to at least partially conceal the trim breaker 20.

As shown in FIG. 7, at least one engagement arm 38 extends forwardly from the second leg 238 of the lower member 116 (i.e., a second adapter member 28). The engagement arm 38 may be one of a plurality of engagement arms 38 spaced apart along a length of the lower member 116 (see FIG. 4) or may be a continuous engagement arm 38 extending along at least a portion of the length of the lower member 116. The engagement arm 38 may be hook-shaped and configured to engage with the cover 46 of the heat loop assembly 44. For example, the engagement arm 38 may be configured to engage with the clip member 50 of the heat loop assembly 44 to at least partially couple the heat loop assembly 44 with the lower member 116 and the trim breaker 20.

With continued reference to FIGS. 3 and 7, the upper member 160 of the second trim adapter assembly 24 is illustrated coupled with a lower portion 250 of the mullion section 242. The lower portion 250 extends downward from the upper portion 246 and is integrally formed with the upper portion 246. A foot 252 is integrally formed with the lower portion 250 and extends forward of the trim breaker 20.

As previously introduced, the upper member 160 of the second trim adapter assembly 24 is configured as a fourth adapter member 32. The upper member 160 includes a body 262 having a forward portion 264 at least partially aligned with the cover 46 of the heat loop assembly 44. The body 262 is positioned forward of the foot 252 of the lower portion 250 of the mullion section 242 and is configured to at least partially conceal the foot 252 of the lower portion 250.

As illustrated in FIG. 7, the body 262 of the upper member 160 further includes a leg 266 extending rearward from the forward portion 264 and at least partially aligned with the lower portion 250 of the mullion section 242. The body 262 further defines a receiving space 268 proximate the leg 266. The receiving space 268 is configured to receive the foot 252 of the lower portion 250 such that the leg 266 extends along the lower portion 250 of the mullion section 242.

As shown in FIG. 7, at least one engagement arm 42 extends forwardly from the leg 266 of the upper member 160 (i.e., a fourth adapter member 32). The engagement arm 42 may be one of a plurality of engagement arms 42 spaced apart along a length of the upper member 160 (see FIG. 5) or may be a continuous engagement arm 42 extending along at least a portion of the length of the upper member 160. The engagement arm 42 may be hook-shaped and configured to engage with the cover 46 of the heat loop assembly 44. For example, the engagement arm 42 may be configured to engage with the clip member 50 of the heat loop assembly 44 to at least partially couple the heat loop assembly 44 with the upper member 160 and the trim breaker 20.

Figure 8:
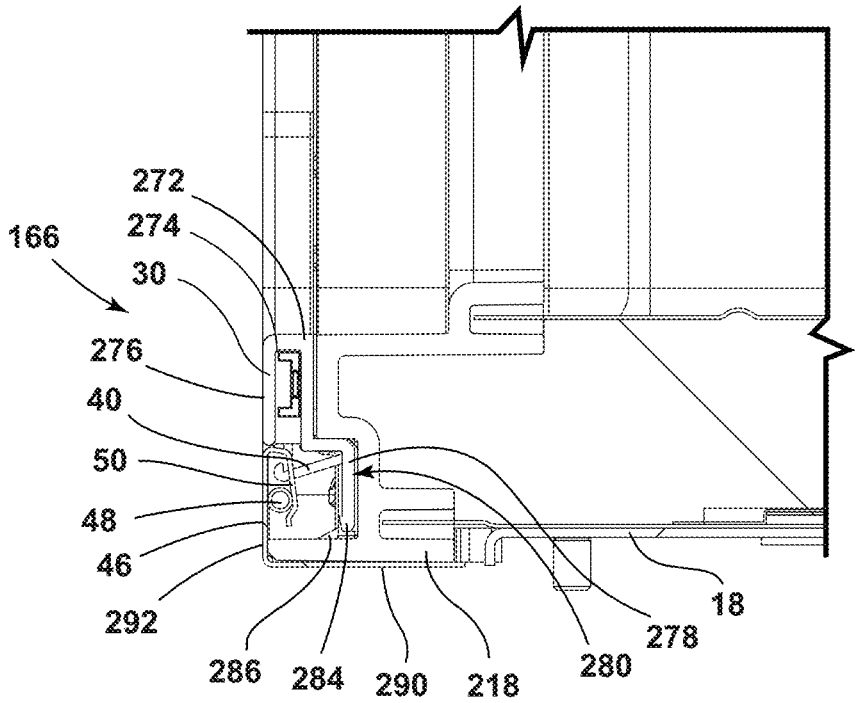
FIG. 8 is an enlarged view of area VIII of FIG. 3 illustrating a bottom wall of the appliance cabinet coupled with a trim breaker assembly.

Referring now to FIG. 8, a cross-sectional view of the lower member 166 of the second trim adapter assembly 24 is illustrated. The lower member 166 is configured as a third adapter member 30, as previously discussed, and is shown engaged with the trim breaker 20 and the heat loop assembly 44. While only the lower member 166 is shown, it will be understood that any member configured as a third adapter member 30 (e.g., each of the side members 162, 164 of the second trim adapter assembly 24) includes substantially the same or substantially similar features and is coupled with the heat loop assembly 44 and the trim breaker 20 in substantially the same manner or in a substantially similar manner.

As shown in FIG. 8, the lower member 166 includes a body 274 having a rear portion 272 spaced apart from a forward portion 276. The rear portion 272 is positioned to align with at least a portion of the trim breaker 20 and is substantially parallel with the forward portion 276. The forward portion 276 is configured to be aligned with at least a portion of the cover 46 of the heat loop assembly 44 and abuts the cover 46 at a terminal end.

The lower member 166 further includes a leg 278 positioned within a recess 280 defined by the trim breaker 20. The leg 278 extends along at least a portion of the trim breaker 20 within the recess 280. The leg 278 is integrally formed with the rear portion 272 and extends at least partially parallel with the rear portion 272 and the forward portion 276. For example, the leg 278 may be L-shaped such that a portion of the leg 278 is perpendicular to the rear portion 272 and a portion of the leg 278 is parallel with the rear portion 272. Alternatively, the leg 278 may extend downward from the rear portion 272 and be oriented substantially parallel with the rear portion 272 and the forward portion 276.

With continued reference to FIG. 8, the leg 278 may include a foot 284 configured to abut an outer portion 218 of the trim breaker 20. Alternatively, the foot 284 may be positioned proximate the outer portion 218 of the trim breaker 20. The outer portion 218 of the trim breaker 20 may include a tab 286 extending into the recess 280. The tab 286 is configured to engage with the foot 284 of the leg 278 to retain the lower member 166 in contact with the trim breaker 20. In various examples, the foot 284 may be configured to snap engage with the tab 286. It will be understood that any number of tabs 286 may be defined along the trim breaker 20 to retain the lower member 166 without departing from the scope of the present disclosure.

As shown in FIG. 8, at least one engagement arm 40 extends forwardly from the leg 278 of the lower member 166. The engagement arm 40 may be one of a plurality of engagement arms 40 spaced apart along a length of the lower member 166 (see FIG. 5) or may be a continuous engagement arm 40 extending along at least a portion of the length of the lower member 166. As illustrated, the engagement arm 40 may be hook-shaped and configured to engage with the cover 46 of the heat loop assembly 44. For example, the engagement arm 40 may be configured to engage with the clip member 50 of the heat loop assembly 44 to at least partially couple the heat loop assembly 44 with the lower member 166 and the trim breaker 20.

Figure 9:
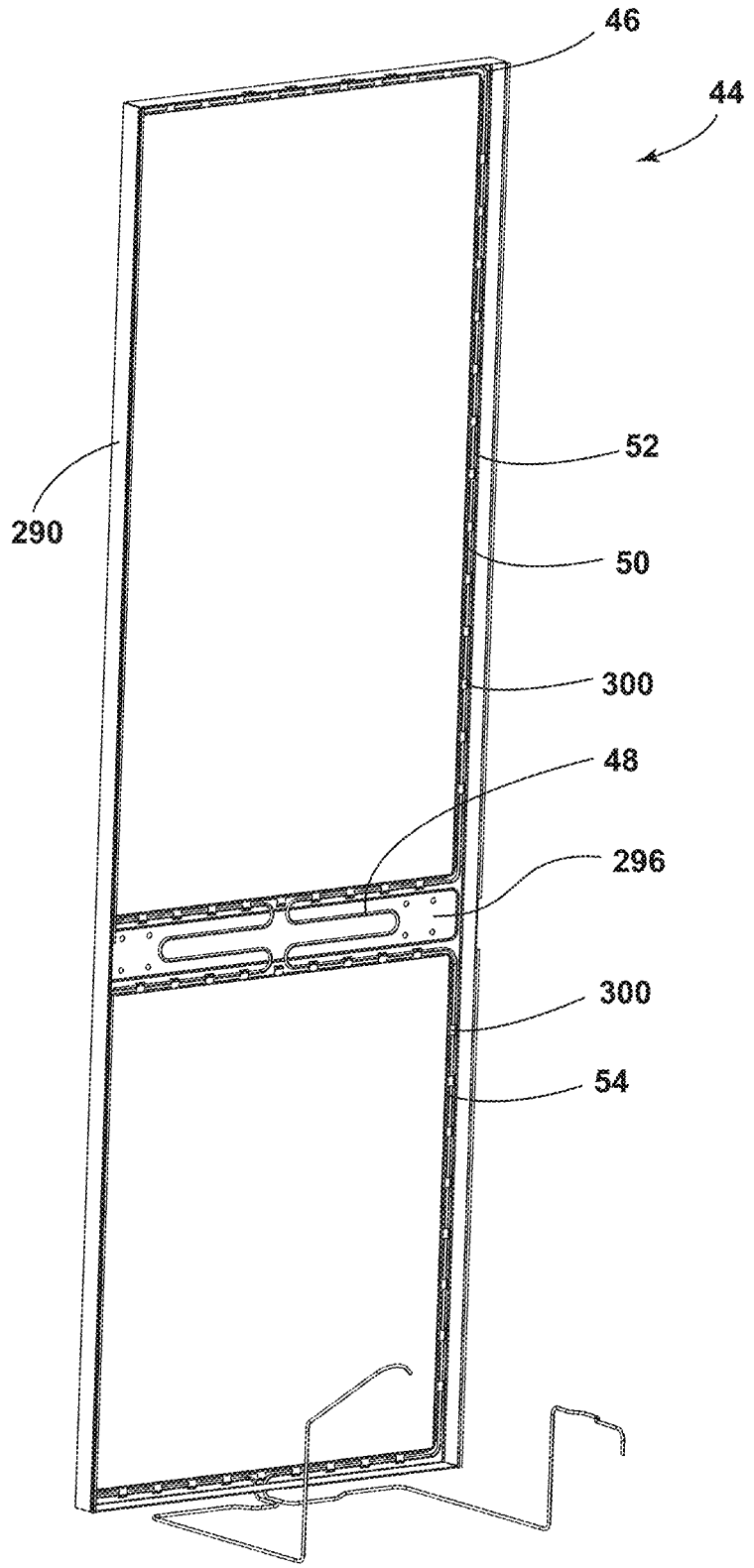
FIG. 9 is rear perspective view of a cover separated from the appliance cabinet of FIG. 1.
Figure 10:
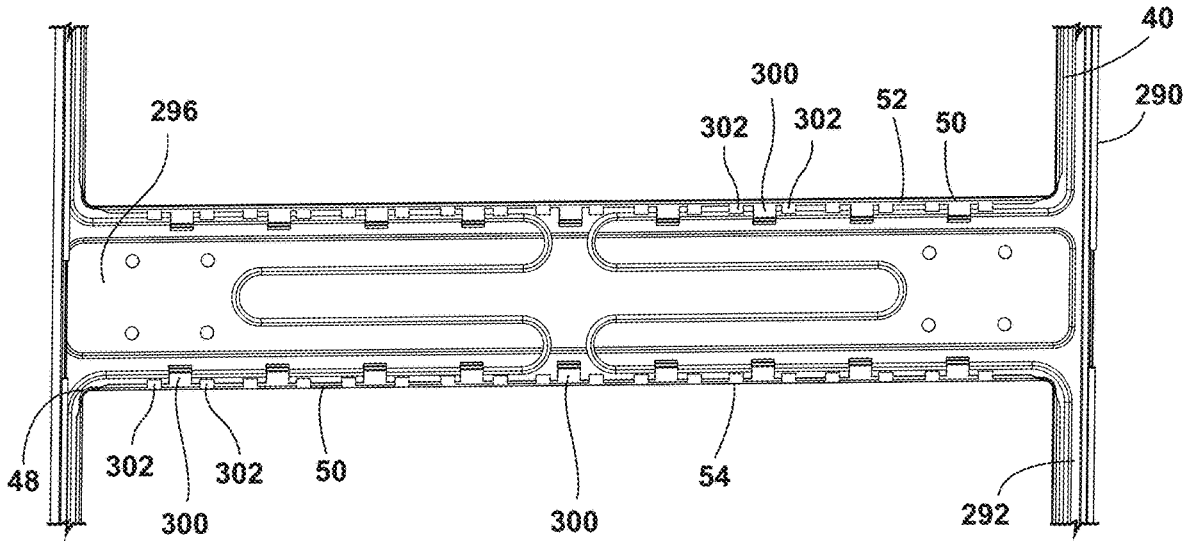
FIG. 10 is an enlarged view of a mullion portion of the cover.
Figure 11:
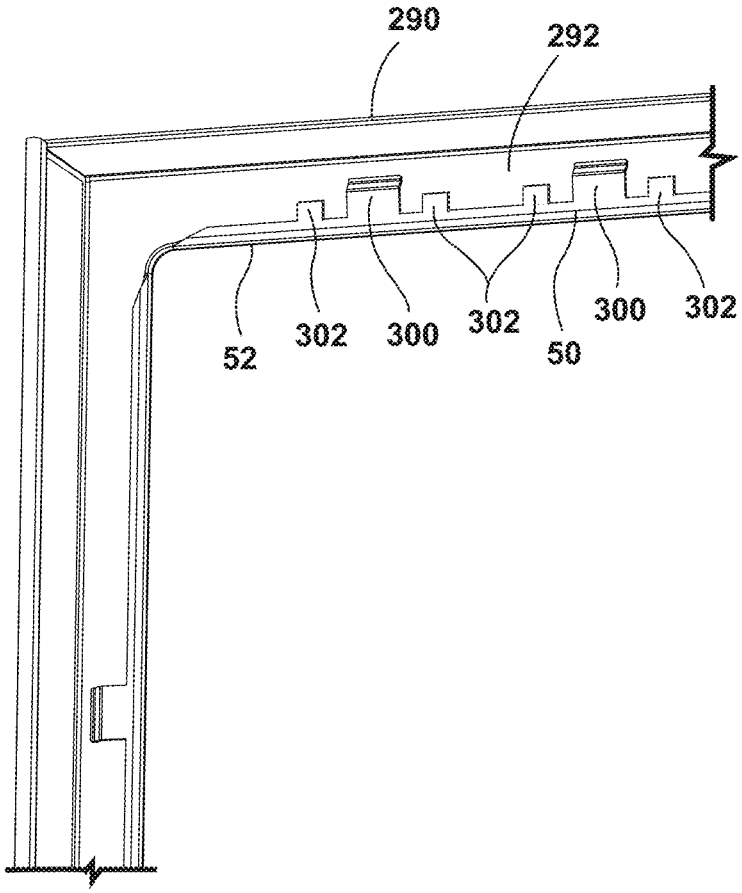
FIG. 11 is an enlarged partial view of an upper portion and side portion of the cover.

Referring now to FIGS. 6-11, the heat loop assembly 44 is illustrated operably coupled with the first and second adapter assemblies 22, 24 (FIGS. 6-8) and separated from the appliance 10 and other components (FIGS. 9-11). As introduced above, the heat loop assembly 44 includes the cover 46 configured to couple with the adapter members 26, 28, 30, 32 of the first and second adapter assemblies 22, 24 to retain and conceal the heat loop 48.

In various examples, as illustrated in FIGS. 1-3, the heat loop assembly 44 may be configured to surround both the refrigerator compartment 60 and the freezer compartment 66 and conceal the mullion 68. The heat loop assembly 44 includes an upper portion 294, a mullion portion 296, and a lower portion 298. The upper portion 294 is configured to align with and engage with the first trim adapter assembly 22 proximate the refrigerator compartment 60, and the lower portion 298 is configured to align with and engage with the second trim adapter assembly 22 proximate the freezer compartment 66. The mullion portion 296 extends between the upper and lower portions 294, 298 and is configured to cover and/or conceal the mullion 68. The cover 46 further includes a first side 290 configured as a side portion and a second side 292 configured as a forward portion. As shown in FIGS. 9-11, the first side 290 extends about a periphery of the cover 46 and is positioned substantially perpendicular to the second side 292.

As best shown in FIGS. 6 and 8, when the heat loop assembly 44 is coupled with the first and second adapter assemblies 22, 24, the first side 290 is configured to extend along the outer portion 218 of the trim breaker 20 and is configured to at least partially cover the trim breaker 20. In various examples, the first side 290 may be coupled with the outer portion 218 of the trim breaker 20. For example, the first side 290 may be welded or adhered to the outer portion 218 or may be coupled with the outer portion 218 via fasteners. Referring now to FIGS. 6-8, the second side 292 is configured to at least partially conceal the first and second adapter assemblies 22, 24 and the trim breaker 20. In other words, the second side 292 of the cover 46 may be positioned forward of at least part of each of the adapter members 26, 28, 30, 32 and the trim breaker 20. In various examples, the second side 292 may be positioned to align with the forward portions 204, 232, 264, 276 of each of the adapter members 26, 28, 30, 32.

As illustrated in FIG. 9, the second side 292 may include an upper inner edge 52 and a lower inner edge 54. The upper inner edge 52 may be configured to frame the first opening 94 when the heat loop assembly 44 is coupled with the appliance 10, and the lower inner edge 54 may be configured to frame the second opening 98 when the heat loop assembly 44 is coupled with the appliance 10.

Referring now to FIGS. 9-11, the second side 292 of the cover 46 may further be configured to support and/or retain the heat loop 48. For example, a plurality of clip members 50 may be positioned along each inner edge 52, 54. The plurality of clip members 50 extend from the inner edges 52, 54 in a direction parallel to the first side 290 of the cover 46. Each clip member 50 may be coupled with the second side 292 of the cover 46 or may be integrally formed with the second side 292 of the cover 46. The heat loop 48 is positioned along the second side 292 of the cover 46 and is coupled with the cover 46 by the plurality of clip members 50.

Each clip member 50 may include a plurality of clips 300. The plurality of clips 300 are interspaced along the clip member 50 and may be equally or unequally spaced along the clip member 50 and may include any number of clips without departing from the scope of the present disclosure. It is also contemplated that any fastener configured to retain the heat loop 48 on the second side 292 may be used with or in lieu of the plurality of clip members 50.

Each clip member 50 may further include a plurality of spacers 304 interspaced with the plurality of clips 300. The plurality of spacers 304 may be integrally formed with the respective clip member 50 or may be removably coupled with the respective clip member 50. Each spacer 304 extends along the second side 292 of the cover 46 and is configured to space the heat loop 48 away from the respective inner edge 52, 54. It is contemplated that each clip member 50 may have a different configuration of clips 300 and spacers 304 including configurations that have only a plurality of clips 300 or only a plurality of spacers 304 without departing from the scope of the present disclosure.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigerator appliance comprising:

a cabinet including a liner spaced apart from a wrapper;

a trim breaker operably coupled with the liner and the wrapper;

a trim adapter assembly coupled with the trim breaker and including an adapter member and a corner member, wherein the trim breaker defines a forward receiving space and a protrusion of the trim adapter assembly is received by the forward receiving space; and a heat loop assembly operably coupled with the adapter member, the heat loop assembly including a cover and a heat loop disposed between the cover and the trim breaker.

2. The refrigerator appliance of claim 1, further comprising:

a plurality of clips configured to couple the heat loop with the cover.

3. The refrigerator appliance of claim 2, further comprising:

a plurality of spacers configured to position the heat loop along the cover.

4. The refrigerator appliance of claim 3, wherein the plurality of clips are configured to retain the heat loop and the plurality of spacers are configured to positioned the heat loop relative to an edge of the cover.

5. The refrigerator appliance of claim 1, wherein the adapter member includes at least one engagement arm, and wherein the engagement arm is hook-shaped and configured to engage with the cover.

6. The refrigerator appliance of claim 1, wherein the corner member includes at least one prong extending therefrom.

7. The refrigerator appliance of claim 6, wherein a first prong of the at least one prong extends substantially perpendicular to a second prong of the at least one prong.

8. The refrigerator appliance of claim 7, wherein the first and second prongs are configured to be received by a receiving well of one of an upper member and a side member of the trim adapter assembly.

9. A refrigerator appliance comprising:

a cabinet including an inner liner, an outer wrapper, and a trim breaker;

an adapter member including a plurality of engagement arms and a leg extending along a portion of the trim breaker, wherein the trim breaker defines a receiving space configured to receive the leg;

a cover configured to be engaged with the plurality of engagement arms to couple the cover with a trim adapter assembly; and a heat loop in abutting contact with an inside surface of the cover.

10. The refrigerator appliance of claim 9, wherein the cover includes a side portion and a front portion, the front portion configured to at least partially conceal the trim adapter assembly.

11. The refrigerator appliance of claim 9, wherein each engagement arm of the plurality of engagement arms is hook-shaped and configured to engage with the cover.

12. The refrigerator appliance of claim 9, further comprising:

a trim adapter assembly coupled with the trim breaker and including a corner member that includes at least one prong extending therefrom.

13. The refrigerator appliance of claim 12, wherein a first prong of the at least one prong extends substantially perpendicular to a second prong of the at least one prong.

14. The refrigerator appliance of claim 13, wherein the first and second prongs are configured to be received by a receiving well of one of an upper member and a side member of the trim adapter assembly.

15. The refrigerator appliance of claim 9, wherein the leg includes a foot, and the trim breaker includes a tab configured to be engaged with the foot.

16. A refrigerator appliance comprising:

a cabinet including an inner liner operably coupled to an outer wrapper;

a trim breaker operably coupled to the inner liner and the outer wrapper;

a trim adapter assembly operably coupled to the trim breaker and including an upper member, a first side member, a second side member, and a lower member, wherein the upper member is detachably coupled to the first side member and the second side member and the lower member is detachably coupled to the first side member and the second side member; and a cover engaged with an adapter member by a plurality of clips interspaced along a clip member.

17. The refrigerator appliance of claim 16, wherein each of the upper member, the first side member, the second side member, and the lower member includes a body having a forward portion, the forward portion aligned with a side of the cover.

18. The refrigerator appliance of claim 16, wherein the trim breaker defines a receiving space and at least one of the upper member, the first side member, the second side member, and the lower member includes a leg configured to be received by the receiving space.

19. The refrigerator appliance of claim 16, wherein the cabinet includes a mullion and the trim adapter assembly includes an extension member, and further wherein the extension member is coupled with the lower member.

20. The refrigerator appliance of claim 16, wherein at least one of the upper member, the first side member, the second side member, and the lower member includes an engagement arm configured to engaged with the clip member.

* * * * *